US009975341B2

(12) United States Patent
Kawabata

(10) Patent No.: US 9,975,341 B2
(45) Date of Patent: May 22, 2018

(54) LIQUID DISCHARGE APPARATUS AND METHOD FOR MAINTAINING LIQUID DISCHARGE APPARATUS

(71) Applicant: Yoichi Kawabata, Kanagawa (JP)

(72) Inventor: Yoichi Kawabata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/495,083

(22) Filed: Apr. 24, 2017

(65) Prior Publication Data

US 2017/0320326 A1 Nov. 9, 2017

(30) Foreign Application Priority Data

May 9, 2016 (JP) ..... 2016-093761
Feb. 10, 2017 (JP) ..... 2017-022981

(51) Int. Cl.
*B41J 2/165* (2006.01)
*B41J 2/18* (2006.01)

(52) U.S. Cl.
CPC ..... *B41J 2/16505* (2013.01); *B41J 2/16552* (2013.01)

(58) Field of Classification Search
CPC ..... B41J 2/18; B41J 2/16505; B41J 2/16552
See application file for complete search history.

(56) References Cited

U.S. PATENT DOCUMENTS

2009/0289992 A1 11/2009 Kawabata
2010/0021635 A1* 1/2010 Ookawa ..... B41J 2/175 427/256
2010/0026739 A1* 2/2010 Hirashima ..... B41J 2/16523 347/6
2012/0139992 A1 6/2012 Kawabata
2015/0077478 A1 3/2015 Kawabata et al.
2016/0221345 A1* 8/2016 Conradie ..... B41J 2/16517

FOREIGN PATENT DOCUMENTS

JP 2000-062213 2/2000
JP 2011-025565 2/2011

* cited by examiner

*Primary Examiner* — Jason Uhlenhake
(74) *Attorney, Agent, or Firm* — Cooper & Dunham LLP

(57) ABSTRACT

The liquid discharge apparatus includes a liquid discharge head having nozzles formed therein, to discharge liquid from the nozzles and a cap to contact with or separate from the liquid discharge head to maintain the liquid discharge head. The liquid discharge head includes a common chamber connected to the nozzles, a liquid supply port provided at one end of the liquid discharge head in a longitudinal direction of the liquid discharge head to supply liquid to one end of the common chamber, and a liquid discharge port provided at another end of the liquid discharge head in the longitudinal direction to discharge liquid, which flows through the common chamber and is not discharged from the nozzles, from another end of the common chamber. The cap includes a drainage supply port to be connected with the liquid discharge port of the liquid discharge head with a connection path.

7 Claims, 8 Drawing Sheets

LIQUID DISCHARGE APPARATUS AND METHOD FOR MAINTAINING LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2016-093761, filed on May 9, 2016 and Japanese Patent Application No. 2017-022981, filed on Feb. 10, 2017 in the Japan Patent Office, the entire disclosures of which are hereby incorporated by reference herein.

BACKGROUND

Technical Field

Aspects of the present disclosure relate to a liquid discharge apparatus for discharge liquid and a method for maintaining a liquid discharge apparatus.

Related Art

As an image-forming apparatus, such as a printer, a facsimile machine, a plotter, or a multifunction machine including at least two of these functions, a liquid discharge apparatus that uses a recording head (liquid discharge head) for discharging ink droplets (liquid droplets) is known.

SUMMARY

In at least one embodiment of the present disclosure, there is provided a novel liquid discharge apparatus. The liquid discharge apparatus includes a liquid discharge head having nozzles forming therein, to discharge liquid from the nozzles and a cap to contact with or separate from the liquid discharge head to maintain the liquid discharge head. The liquid discharge head includes a common chamber connected to the nozzles, a liquid supply port provided at one end of the liquid discharge head in a longitudinal direction of the liquid discharge head to supply liquid to one end of the common chamber, and a liquid discharge port provided at another end of the liquid discharge head in the longitudinal direction of the liquid discharge head to discharge liquid, which flows through the common chamber and is not discharged from the nozzles, from another end of the common chamber. The cap includes a drainage supply port to be connected with the liquid discharge port of the liquid discharge head with a connection path, and a drainage discharge port to be connected with a suction pump to discharge liquid inside the cap.

In at least one embodiment of the present disclosure, there is provided a novel method for maintaining a liquid discharge apparatus including a liquid discharge head and a cap. The method includes connecting the liquid discharge head and the cap with a connection path with the cap separated from a nozzle face of the liquid discharge head, supplying cleaning liquid to the liquid discharge head connected to the cap with the connection path to supply the cleaning liquid to the cap through the liquid discharge head and the connection path, discharging the cleaning liquid from the cap connected to the liquid discharge head with the connection path, and repeating the supplying and the discharging to replace liquid inside the liquid discharge head and the cap with the cleaning liquid.

Figure 1:
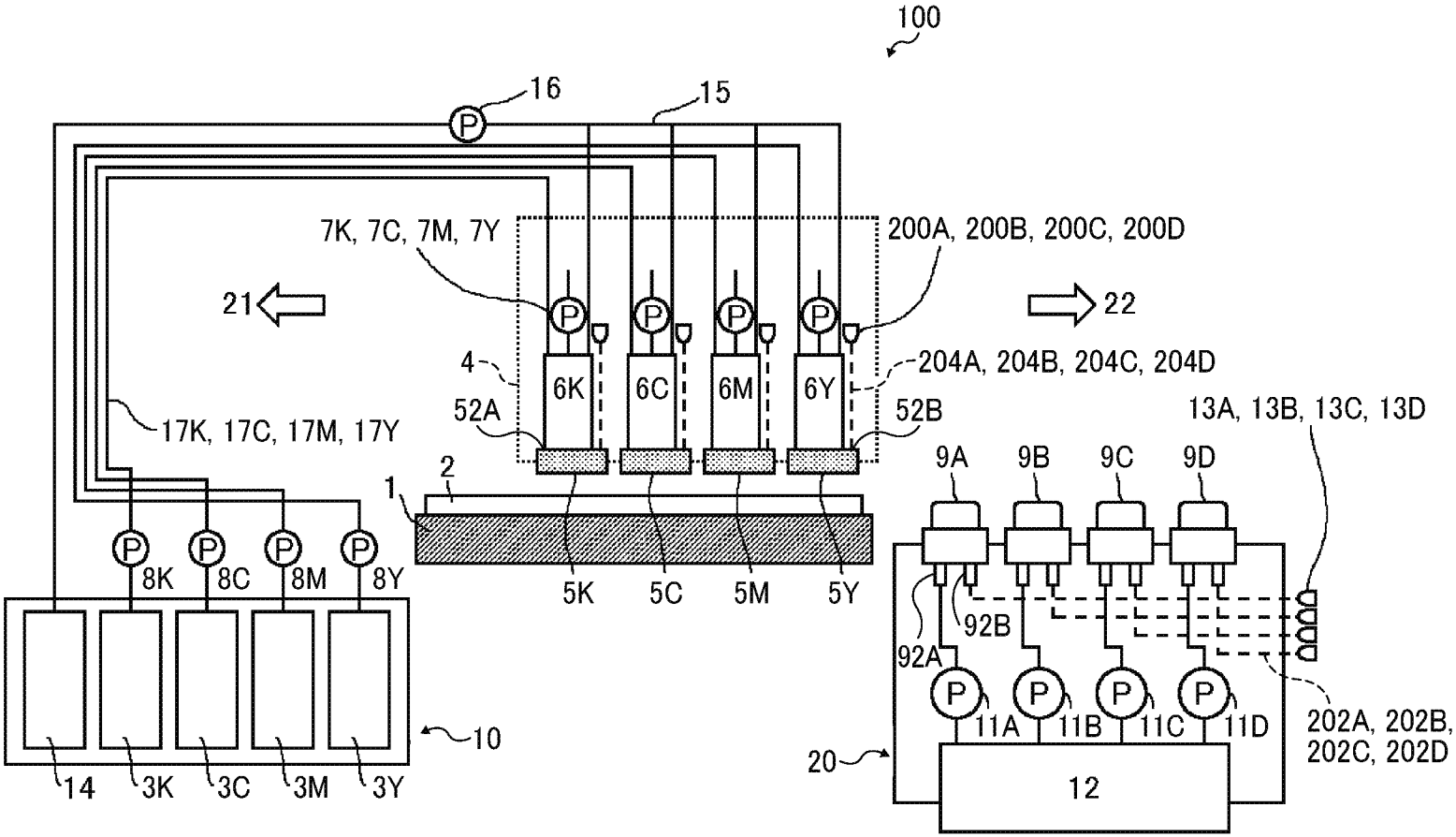
FIG. 1 is a schematic structural diagram of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

FIG. 1 is a schematic structural diagram of a liquid discharging apparatus 100 according to an embodiment of the present disclosure. The liquid discharge apparatus 100 includes a carriage 4 and a conveyance stage 1. The carriage 4 reciprocally scans in a forward direction 21 and a reverse direction 22. The convey stage 1 conveys a sheet 2 as a recording medium. The carriage 4 includes liquid discharge heads 5K, 5C, 5M, and 5Y (also collectively "liquid discharge head 5"). The carriage 4 scans in a direction perpendicular to a conveyance direction of the sheet 2 to form an image on the sheet 2.

Figure 2A:
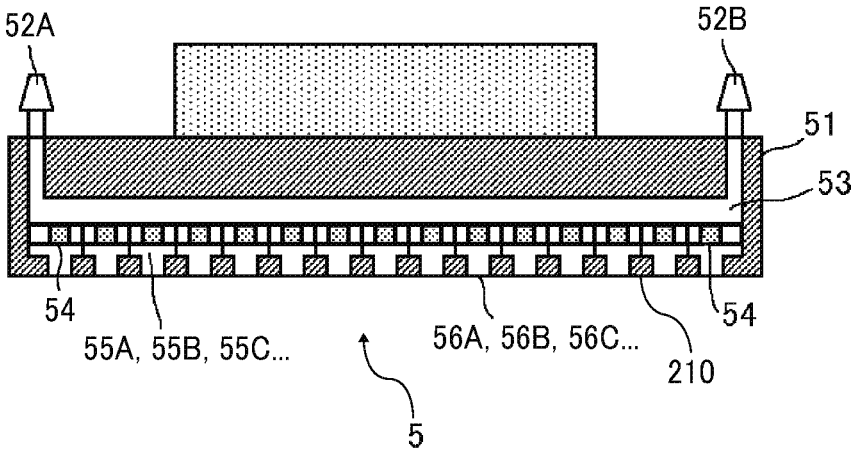
FIG. 2A is a schematic cross-sectional view of a liquid discharge head.
Figure 2B:
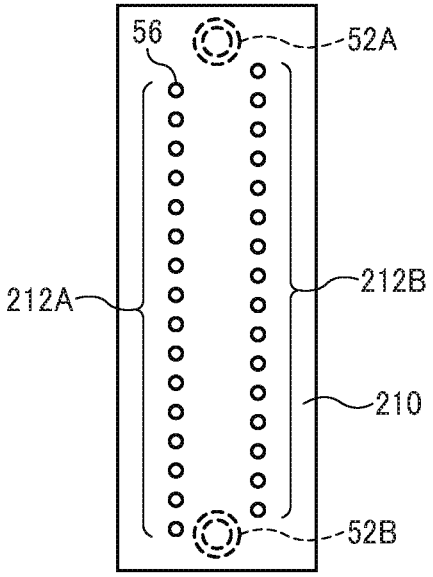
FIG. 2B is a plan view of a nozzle face of a liquid discharge head.

Each of the liquid discharge heads 5K, 5C, 5M, and 5Y includes nozzles 56 as illustrated in FIG. 2A to 2B. The liquid discharge heads 5K, 5C, 5M, and 5Y discharge ink droplets of black (K), cyan (C), magenta (M), and yellow (Y), respectively, in a downward direction from the nozzles 56. The liquid discharge head 5 has a nozzle face 210 on which nozzle arrays 212A and 212B (also collectively "nozzle array 212") formed of a plurality of nozzles 56 arrayed in a direction perpendicular to the scanning direction of the carriage 4.

The liquid discharge head 5 includes an energy source for generating energy to discharge liquid droplets. Examples of the energy source include a piezoelectric actuator such as a piezoelectric element, a thermal actuator, a shape-memory alloy actuator, and an electrostatic actuator. The thermal actuator employs a thermoelectric conversion element, such as a thermal resistor. The thermoelectric conversion element generates phase change of ink through film boiling. The shape-memory alloy actuator employs a metal phase change generated by a temperature change. The electrostatic actuator employs electrostatic force. The liquid discharge head 5 mounts driver IC (Integrated Circuit), which is connected to a controller of a body of the liquid discharge apparatus 100 with a harness.

Further, the carriage 4 mounts sub-tanks 6K, 6C, 6M, and 6Y (also collectively "sub-tank 6"). Each of the sub-tanks 6K, 6C, 6M, and 6Y supplies corresponding colors of ink (liquid) to the liquid discharge head 5. The liquid discharge apparatus 100 includes a main tank mounting portion 10 to which replaceable main tanks 3K, 3C, 3M, and 3Y (also collectively "main tank 3") are mounted. The main tank 3 stores ink supplied to the sub-tank 6. Ink supply tubes 17K, 17C, 17M, 17Y (also collectively "ink supply tube 17") connect the sub-tanks 6K, 6C, 6M, and 6Y with the main tanks 3K, 3C, 3M, and 3Y, respectively. Ink of each color is supplied from the main tank 3 to the sub-tank 6 through the ink supply tube 17.

The liquid discharge apparatus 100 includes air pumps 7K, 7C, 7M, and 7Y (also collectively "air pump 7") connected to the top parts of the sub-tanks 6. The air pump 7 acts as a negative pressure forming unit. The air pump keeps a pressure inside the sub-tank 6 in negative pressure to stabilize ink discharge characteristics. The liquid discharge apparatus 100 includes supply pumps 8K, 8C, 8M, and 8Y (also collectively "supply pump 8") on the main tank mounting portion 10 to supply respective colors of ink in the main tanks 3 to the sub-tanks 6.

Further, the liquid discharge apparatus 100 includes a cleaning liquid tank 14 in the main tank mounting portion 10. The cleaning liquid tank 14 stores cleaning liquid used for cleaning inside the liquid discharge head 5. The cleaning liquid tank is connected to each of the liquid discharge heads 5K, 5C, 5M, and 5Y via a cleaning liquid supply tube 15, a cleaning liquid pump 16, and each of the sub-tanks 6K, 6C, 6M, and 6Y.

As illustrated in FIGS. 2A and 2B, the liquid discharge head 5 includes a liquid supply port 52A and a liquid discharge port 52B on both end of a frame 51 in a longitudinal direction of the liquid discharge head 5. Both ends of the frame 51 correspond to both ends of the nozzle array 212 in the longitudinal direction of the liquid discharge head 5.

The liquid discharge head 5 includes a common chamber 53 communicating with the liquid supply port 52A and the liquid discharge port 52B. The liquid discharge head 5 includes a plurality of individual chambers 55 (55A, 55B, 55C, and so on illustrated in FIG. 2A) that connects the common chamber 53 to the nozzles 56 (56A, 56B, 56C, and so on illustrated in FIG. 2A). The liquid discharge head 5 includes a plurality of actuators 54 provided at the plurality of individual chambers 55. The liquid discharge head 5 drives the actuators 54 to generate a pressure inside the individual chambers 55 so that the ink inside the individual chambers 55 is discharged from the nozzles 56.

The liquid supply port 52A is connected to the sub-tank 6 for supplying ink from the sub-tank 6 to the liquid discharge head 5. The liquid discharge port 52B is used for maintenance of the liquid discharge head 5, such as discharging air generated inside the common chamber 53 or replacing the ink inside the liquid discharge head 5 with the cleaning liquid.

As illustrated in FIG. 1, a maintenance device 20 is provided outside the printing area of the liquid discharge apparatus 100, located at one end of the scanning direction of the carriage 4. The maintenance device 20 maintains the liquid discharge head 5 to stably discharge liquid. This maintenance device 20 includes caps 9A, 9B, 9C, and 9D (also collectively "cap 9") to cap a nozzle face 210 of the liquid discharge head 5.

A plurality of nozzle arrays 212A and 212B is provided on the nozzle face 210 of the liquid discharge head 5. The cap 9 is capable of being moved vertically upward and downward to contact with or separate from the nozzle face 210 of the liquid discharge head 5.

As illustrated in FIG. 1, each of the caps 9A, 9B, 9C, and 9D includes a drainage discharge port 92A and a drainage supply port 92B. The drainage discharge ports 92A of the caps 9A, 9B, 9C, and 9D are connected to corresponding suction pumps 11A, 11B, 11C, and 11D (also collectively "suction pump 11"), respectively. The drainage supply ports 92B of the caps 9A, 9B, 9C, and 9D can be connected to the liquid discharge ports 52B of the liquid discharge heads 5K, 5C, 5M, and 5Y, respectively. A waste liquid tank 12 is connected to each of the suction pumps 11A, 11B, 11C, and 11D to store waste liquid vacuumed up from the drainage discharge port 92A of the cap 9 by the suction pump 11.

The drainage supply port 92B of the cap 9 is connected to the liquid discharge port 52B of the liquid discharge head 5 in the present embodiment. However, in case the liquid discharge apparatus is large, the movement path of the carriage 4 becomes long. Thus, a connection tube 206 for connecting the drainage supply port 92B of the cap 9 and the liquid discharge port 52B of the liquid discharge head 5 also has to be long.

Thus, as illustrated in FIG. 1, cap couplings 13A, 13B, 13C, and 13D (also collectively "cap coupling 13") are provided to ends of cap connection tubes 202A, 202B, 202C, and 202D (also collectively "cap connection tube 202") connected to the drainage supply ports 92B of the caps 9. Further, head couplings 200A, 200B, 200C, and 200D (also collectively "head coupling 200") are provided to ends of head connection tubes 204A, 204B, 204C, and 204D (also collectively "head connection tube 204") connected to the liquid discharge ports 52B of the liquid discharge heads 5. When ink inside the liquid discharge head 5 is replaced with the cleaning liquid, the cap coupling 13 of the drainage supply port 92B of the cap 9 is connected to the head coupling 200 of the liquid discharge port 52B of the liquid discharge head 5. Even the small sized liquid discharge apparatus may have the head coupling 200 and the cap coupling 13 to connect or disconnect the liquid discharge head 5 and the cap 9 during maintenance of the liquid discharge head 5.

A liquid discharge device is an integrated unit including the liquid discharge head 5 and a functional part(s) or unit(s), and is an assembly of parts relating to liquid discharge. For example, the liquid discharge device includes at least one of the liquid discharge head 5, the carriage 4, the sub-tank 6, an ink supply device, and the maintenance device 20. The ink supply device includes the main tank mounting portion 10, the main tank 3, and the supply pump 8. In the above-described embodiment of the present disclosure, the liquid discharge apparatus includes a liquid discharge device that drives the liquid discharge head 5 to discharge liquid.

The liquid discharge apparatus 100 regularly performs a head maintenance process on the liquid discharge head 5. The head maintenance process performs capping of the liquid discharge head 5 with the cap 9, vacuuming up ink from the liquid discharge head 5, separating the cap 9 from the liquid discharge head 5, and discharging ink from the cap 9 in a sequential manner. Further, the liquid discharge apparatus 100 performs a replacement process. The replacement process introduces cleaning liquid into the ink supply path of the liquid discharge apparatus 100 to replace ink with the cleaning liquid so as to clean the liquid supply path and an area around the nozzles 56.

Figure 3:
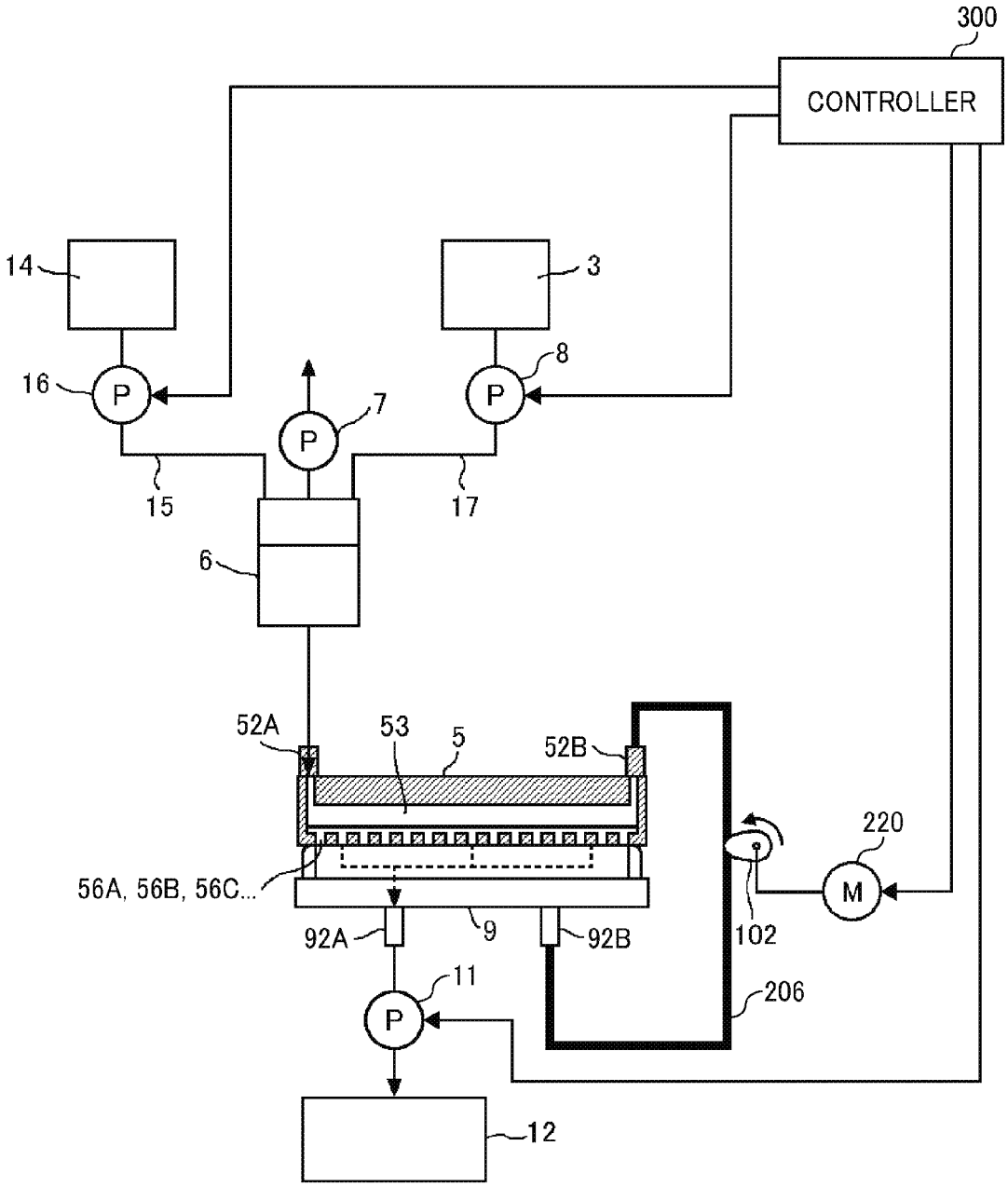
FIG. 3 is a schematic view of the liquid discharge apparatus during a head maintenance process according to the embodiment of the present disclosure.
Figure 4:
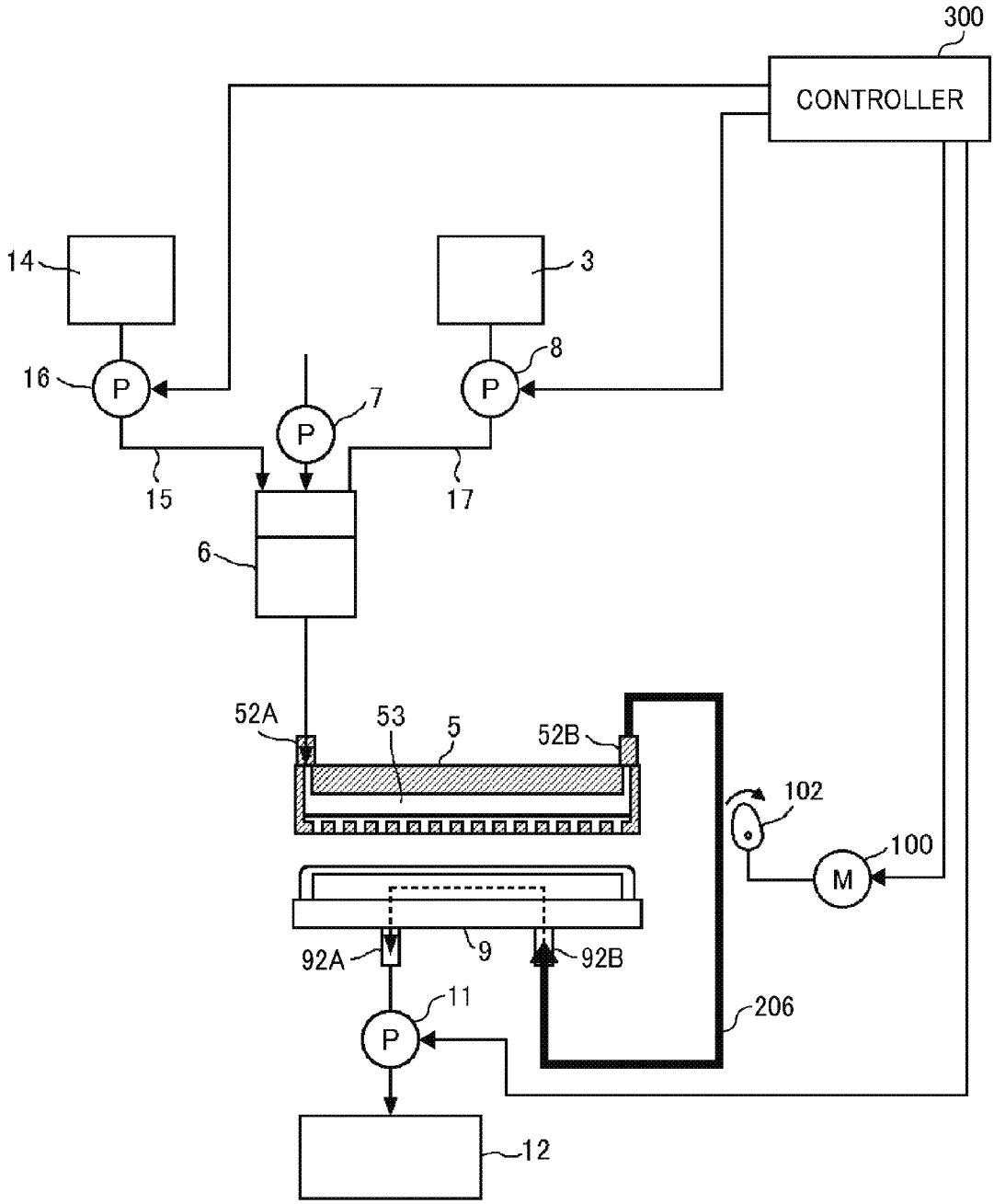
FIG. 4 is a schematic view of the liquid discharge apparatus during a replacement process according to the embodiment of the present disclosure.

FIG. 3 illustrates a connection status of the liquid supply path and the maintenance device during a normal head maintenance process. FIG. 4 illustrates a connection status of the liquid supply path and the maintenance device during the replacement process.

As illustrated in FIG. 3, in the normal head maintenance, the cap 9 contacts the nozzle face 210 of the liquid discharge head 5 to cap the liquid discharge head 5. Then, a controller 300 drives a cam motor 220 to rotate a cam 102 so that the cam 102 compresses the connection tube 206 to substantially block liquid flow between the liquid discharge head 5 and the cap 9 while the cap 9 caps the liquid discharge head 5. The connection tube 206 connects the liquid discharge port 52B of the liquid discharge head 5 and the drainage supply port 92B of the cap 9, and thus acts as a connection path between the liquid discharge port 52B of the liquid discharge head 5 and the drainage supply port 92B of the cap 9.

Then, the controller 300 drives the suction pump 11 to generate negative pressure inside the cap 9 so that the suction pump 11 vacuums up the ink from the nozzles of the liquid discharge head 5 and discharges the vacuumed waste ink to the waste liquid tank 12. Thus, the maintenance device 20 can maintain good liquid discharge performance of the liquid discharge head 5. The waste ink discharged from the cap 9 is stored in the waste liquid tank 12.

Alternatively, instead of using the cam 102 as illustrated in FIG. 3, the cap coupling 13 and the head coupling 200 may be provided to connect or disconnect the liquid discharge head 5 and the cap 9. When the normal head maintenance process is performed, the cap coupling 13 and the head coupling 200 are disconnected. When the replacement process is performed, the cap coupling 13 and the head coupling 200 are connected.

Preferably, a non-spill coupling is used for the cap coupling 13 and the head coupling 200. The non-spill coupling includes a valve that prevents liquid dripping, which may occur when the coupling is disconnected. Using the non-spill coupling can avoid the unnecessary movement of the lengthy connection tube 206 during scanning of the carriage 4 in printing or during the normal head maintenance.

In order to discharge air generated inside the individual chambers 55, the controller 300 rotates the cam 102 by driving the cam motor 220 to open the connection tube 206 so that the liquid discharge port 52B of the liquid discharge head 5 and the drainage supply port 92B of the cap 9 can communicate as illustrated in FIG. 4. Then, the controller 300 drives the suction pump 11 to vacuum up the liquid path inside the liquid discharge head 5, the connection tube 206, and the cap 9 so as to reduce the pressure inside the individual chambers 55 and the common chamber 53 of the liquid discharge head 5. Thus, the ink flows through the liquid supply port 52A, the common chamber 53, the liquid discharge port 52B, the connection tube 206, the drainage supply port 92B, the inside of the cap 9, and the suction pump 11 to the waste liquid tank 12.

As illustrated in FIG. 4, in order to clean the liquid discharge head 5, the cap 9, and the connection tube 206, the controller 300 rotates the cam 102 to open the connection tube 206 so that the liquid discharge port 52B of the liquid discharge head 5 and the drainage supply port 92B of the cap 9 can communicate. Then, the controller 300 drives the cleaning liquid pump 16 to supply the cleaning liquid from the cleaning liquid tank 14 to the liquid discharge head 5. The cleaning liquid pump 16 is provided between the cleaning liquid tank 14 and the sub-tank 6 and is located upstream of the liquid discharge head 5 in a liquid flow direction. The controller 300 drives the suction pump 11 to generate a negative pressure inside the cap 9 so that the cap 9 vacuums up the ink from the nozzles and the liquid discharge port 52B of the liquid discharge head 5. The waste ink vacuumed up from the liquid discharge head 5 and the cap 9 is discharged to the waste liquid tank 12.

Therefore, the present embodiment can create a circuit that supplies the cleaning liquid, which is used for cleaning inside of the liquid discharge head 5 and replacing ink inside the liquid discharge head 5, to the inside of the cap 9. Thus, the present embodiment can omit a cleaning liquid supply assembly exclusive for cleaning the cap 9.

In the present embodiment, the operation of replacing the ink with the cleaning liquid is performed without capping the liquid discharge head 5 with the cap 9 by connecting the liquid discharge port 52B of the liquid discharge head 5 and the drainage supply port 92B of the cap 9 with the connection tube 206. In this case, the ink inside the liquid discharge head flows through the liquid supply port 52A, the common chamber 53, the liquid discharge port 52B, the connection tube 206, the drainage supply port 92B, the inside of the cap 9, the drainage discharge port 92A, and the suction pump 11 to the waste liquid tank 12. The replacement process of replacing ink with the cleaning liquid while separating the cap 9 from the liquid discharge head 5 is described in further detail later.

Here, the maintenance device 20 according to the present embodiment has four suction pumps 11 for the respective colors of the liquid discharge head 5. However, in some embodiments, the maintenance device 20 may have one suction pump 11 that sequentially vacuums up the liquid discharge heads 5. In this case, for example, the cap that acts as the suction cap connected to the suction pump 11 in the maintenance device 20 is only the cap 9A. The other caps 9B, 9C, and 9D function as protection cap, which prevents drying and adhesion of foreign substances of the nozzles of the liquid discharge head 5.

Since an industrial liquid discharge apparatus prints on a media of large size, the moving distance of the carriage 4, on which the liquid discharge head 5 is mounted, becomes large. Therefore, if the liquid discharge port 52B of the liquid discharge head 5 and the drainage supply port 92B of the cap 9 are always connected, the connection tube 206 connecting the liquid discharge port 52B and the drainage supply port 92B might be long, thus increasing the amount of cleaning liquid used to replace with the ink.

Figure 5:
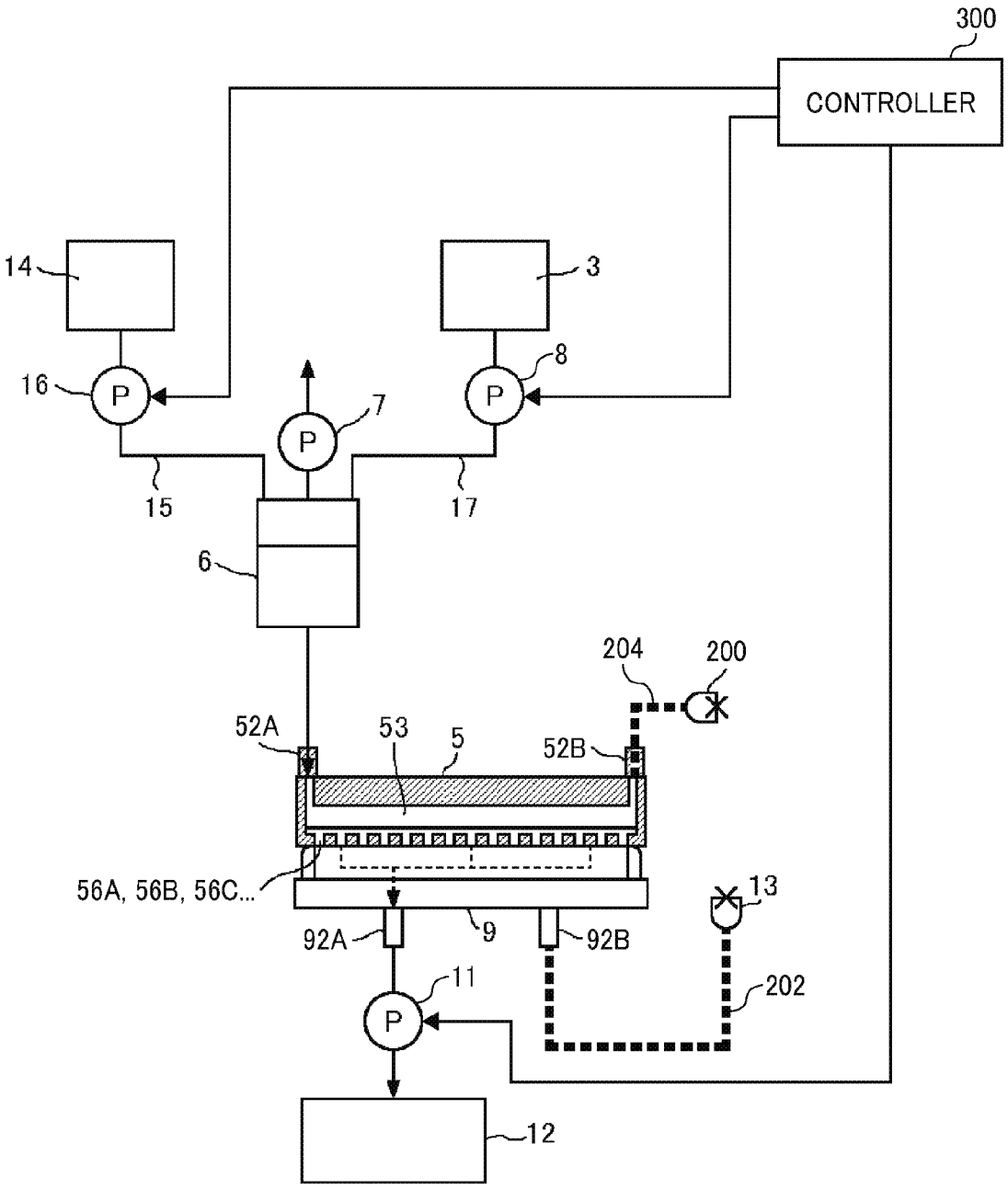
FIG. 5 is a schematic view of the liquid discharge apparatus during a head maintenance process according to another embodiment of the present disclosure.

Thus, in the present embodiment, as illustrated in FIG. 5, the cap coupling 13 is provided at the end of the cap connection tube 202 that is connected to the drainage supply port 92B of the cap 9. The head coupling 200 is provided at the end of the head connection tube 204 that is connected to the liquid discharge port 52B of the liquid discharge head 5. When the normal head maintenance or the printing process is performed, the cap coupling 13 and the head coupling 200 are disconnected. Further, respective ends of the cap coupling 13 and the head coupling 200 are sealed before performing the normal head maintenance or the printing process.

When the ink inside the liquid discharge head 5 is replaced with the cleaning liquid to clean the liquid discharge head 5, the carriage 4 moves to a position where the distance between the drainage supply port 92B of the cap 9 and the liquid discharge port 52B of the liquid discharge head 5 becomes minimum.

Figure 6:
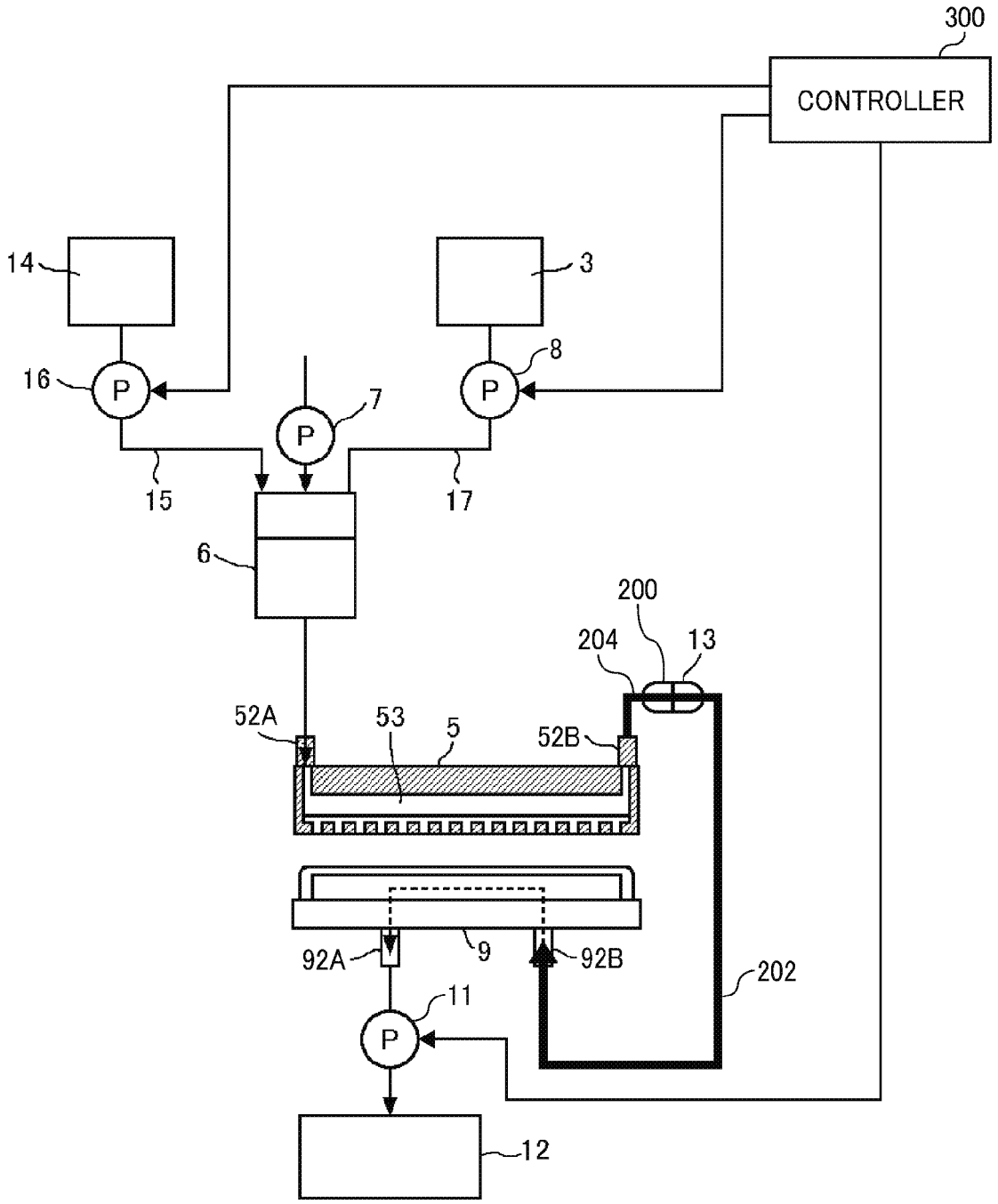
FIG. 6 is a schematic view of the liquid discharge apparatus during a replacement process according to another embodiment of the present disclosure.

Then, as illustrated in FIG. 6, the cap coupling 13 and the head coupling 200 are connected to establish a liquid connection between the drainage supply port 92B and the liquid discharge port 52B. The cap connection tube 202 and the head connection tube 204 create a connection path between the liquid discharge head 5 and the cap 9 when the cap connection tube 202 and the head connection tube 204 are connected. The position where the distance between the drainage supply port 92B and the liquid discharge port 52B becomes minimum is the position where the cap 9 can contact the nozzle face 210 of the liquid discharge head 5.

The head coupling 200 is connected to the liquid discharge port 52B of the liquid discharge head 5 with the head connection tube 204. The cap coupling 13 is connect to the drainage supply port 92B of the cap 9 with the cap connection tube 202. Both of the cap connection tube 202 and the head connection tube 204 are flexible. By connecting the head coupling 200 and the cap coupling 13, the cap connection tube 202 and the head connection tube 204 are connected to create a connection path between the liquid discharge port 52B of the liquid discharge head 5 and the drainage supply port 92B of the cap 9.

As described later, the head coupling 200 and the cap coupling 13 are sealed during normal head maintenance or the printing process. Preferably, a non-spill coupling that is detachably connected by a single operation is used for ease of maintenance and to reduce ink leakage or air invasion from the cap coupling 13 and the head coupling 200 during disconnection of the cap coupling 13 and the head coupling 200.

After connecting the liquid discharge port 52B of the liquid discharge head 5 and the drainage supply port 92B of the cap 9, the controller 300 drives the cleaning liquid pump 16 to supply the cleaning liquid from the cleaning liquid tank 14 to the liquid discharge head 5. The controller 300 drives the suction pump 11 to vacuum up the ink from the liquid discharge head 5 and the cap 9 and discharges the waste ink of the liquid discharge head 5 and the cap 9 to the waste liquid tank 12. The liquid discharge port 52B of the liquid discharge head 5 and the drainage supply port 92B of the cap 9 are connected when the replacement process is performed. Such a configuration can reduce the length of the cap connection tube 202 and the head connection tube 204 and the amount of cleaning liquid necessary for replacing the ink inside the liquid discharge head 5, the cap 9, the cap connection tube 202, and the head connection tube 204.

The user or a maintenance staff is supposed to perform a part of the replacement process such as connecting the head coupling 200 and the cap coupling 13. The replacement process of replacing ink with cleaning liquid is performed for cleaning inside the liquid discharge head 5. The replacement process of replacing cleaning liquid with ink is performed for restarting a printing process. The replacement process of supplying new ink to the liquid discharge head 5 is performed when the liquid discharge head 5 is replaced. The cap coupling 13 and the head coupling 200 are separated after completing the replacement process. Each end of the cap coupling 13 and the head coupling 200 has to be sealed in order to keep the internal pressure of the liquid discharge head 5 constant during printing.

The steps of the replacement process is explained below with reference to FIG. 7.

First, the carriage 4 moves to a position where the cap 9 is contactable against the nozzle face 210 of the liquid discharge head 5 (S1). Then, a connecting process of connecting the head coupling 200 and the cap coupling 13 is performed (S2). The head coupling 200 is connected to the liquid discharge port 52B of the liquid discharge head 5 with the head connection tube 204. The cap coupling 13 is connected the drainage supply port 92B of the cap 9 with the cap connection tube 202.

After connecting the head coupling 200 and the cap coupling 13, the controller 300 drives the cleaning liquid pump 16 to supply the cleaning liquid from the cleaning liquid tank 14 to the sub-tank 6 to pressurize the sub-tank 6 (S3).

Further, the controller 300 drives the suction pump 11 to vacuum up the ink in the cap 9 (S4). Then, the controller 300 performs a cleaning liquid supply process (S5). The controller 300 drives both of the cleaning liquid pump 16 and the suction pump 11 to replace the ink inside the liquid discharge head 5 with the cleaning liquid and clean the cap 9 at the same time in the cleaning liquid supply process (S5). After a predetermined period of time, the controller 300 stops the cleaning liquid pump 16 (S6).

Then, the head coupling 200 and the cap coupling 13 are separated (S7). Then, the cap 9 contacts the nozzle face 210 of the liquid discharge head 5 (S8). The controller 300 drives the suction pump 11 to reduce the pressure inside the cap 9 so as to vacuum up the cleaning liquid inside the individual chambers 55 of the liquid discharge head 5 (S9). The controller 300 stops the suction pump 11 to complete the replacement process (S10).

Figure 7:
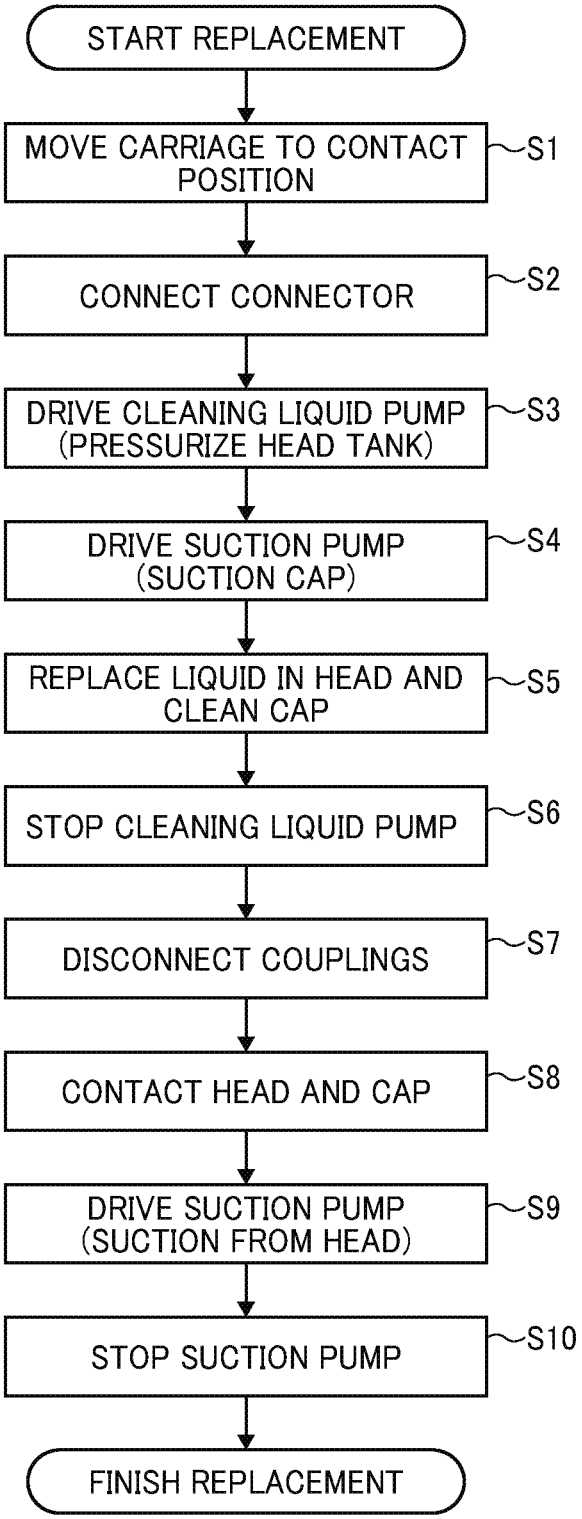
FIG. 7 is a flow chart of the steps in the replacement process according to the embodiment of the present disclosure.
Figures 8A, 8B, 8C, 8D, 8E:
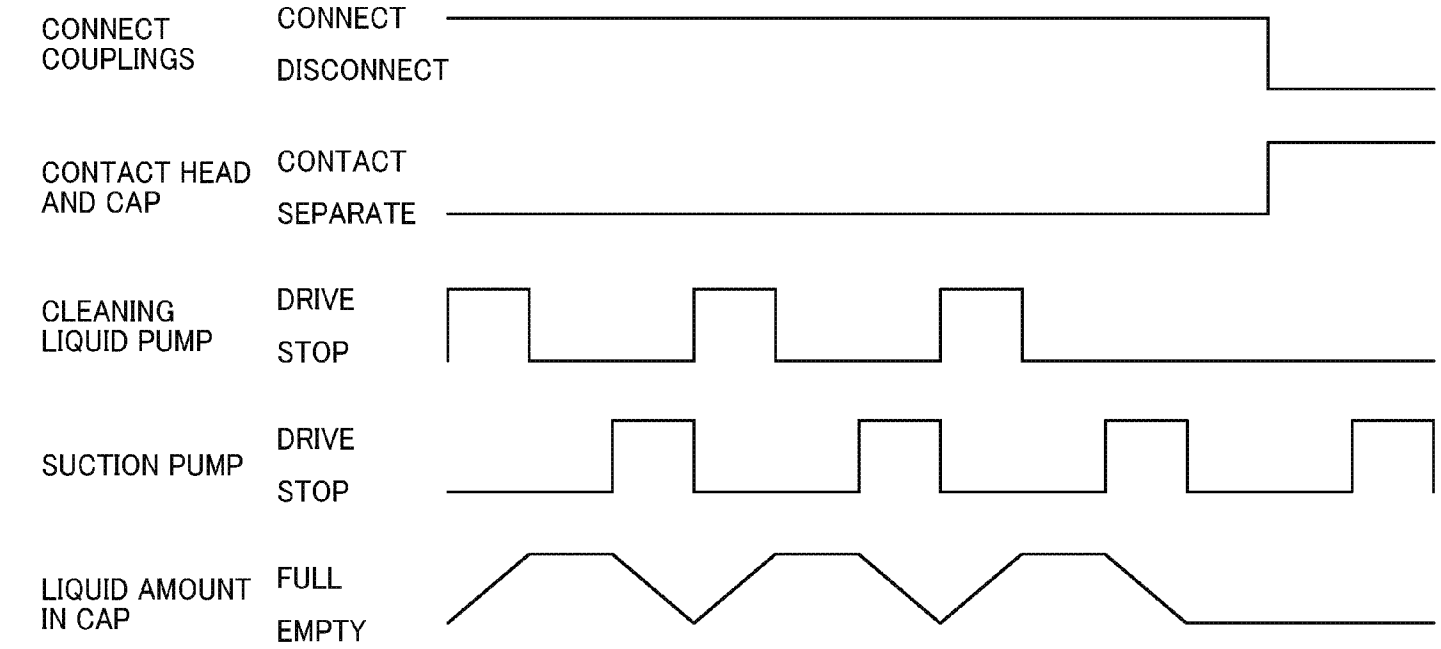
FIGS. 8A, 8B, 8C, 8D, and 8E are timing charts of each part of the liquid discharge apparatus during the replacement process.

The replacement process illustrated in FIG. 7 drives the cleaning liquid pump 16 to pressurize the sub-tank 6 while separating the cap 9 from the nozzle face 210 of the liquid discharge head 5 and connecting the head coupling 200 and the cap coupling 13. Thus, the replacement process utilize the cleaning liquid used for replacing ink inside the liquid discharge head 5 to wash away the ink attached and encrusted inside the cap 9. For example, cap cleaning is performed after the cleaning liquid used for replacing ink inside the liquid discharge head 5 is temporally stored inside the cap 9.

To wash away the ink adhered to the cap 9 with time, it is effective to provide a time for soaking the encrusted ink with the cleaning liquid to accelerate a re-dispersion of the encrusted ink. Therefore, the cleaning liquid supply process (S5) of the replacement process repeating the processes of (a) driving only the cleaning liquid pump 16 until the cleaning liquid is filled inside the cap 9, (b) temporally stopping the cleaning liquid pump 16, (c) driving only the suction pump 11 to discharge the cleaning liquid inside the cap 9. Thus, the replacement process of the present embodiment can create a state in which the cap 9 is filled with the cleaning liquid.

The replacement process of cleaning the cap 9 while separating the cap 9 from the nozzle face 210 can reduce an amount of cleaning liquid used for cleaning the liquid discharge head 5 and the cap 9 compared to the cleaning performed by capping the nozzle face 210 with the cap 9. Further, the replacement process of the present embodiment can prevent the dirt inside the cap 9 from attaching around the nozzles 56 of the liquid discharge head 5.

The replacement process performed by capping the nozzle face 210 with the cap 9 increases the suction time of the suction pump 11 to achieve the same effect as the replacement process of the present embodiment. Thus, not only the amount of cleaning liquid necessary for clean the liquid discharge head 5 and the cap 9 increases, but also the dirt inside the cap 9 may attach around the nozzles 56 and nozzle face 210 of the liquid discharge head 5 because the cap 9 contacts the nozzle face 210 of the liquid discharge head 5.

An optical sensor may be used for detecting the liquid amount inside the cap 9 that directly detects the liquid face inside the cap 9. However, as a simpler configuration, drive time of the cleaning liquid pump 16 may be adjusted according to a supply speed of the cleaning liquid pump 16 and an internal volume of the cap 9.

FIGS. 8A-8E are timing charts that describes a drive timing of the cleaning liquid pump 16 and the suction pump 11.

The replacement process according to FIGS. 8A-8E replaces the ink inside the common chamber 53 with the cleaning liquid in advance and finally replaces the ink inside the individual chambers 55 with the cleaning liquid. Thus, the controller 300 drives the suction pump 11 and generates a negative pressure inside the cap 9 to vacuum up the ink from the nozzles 56 and replace the ink inside the individual chambers 55 with the cleaning liquid while capping the nozzle face 210 of the liquid discharge head 5 with the cap 9 (S9).

The liquid discharge apparatus 100 discharges ink droplets from the nozzles 56 of the liquid discharge head 5 and causes droplets to land on a recording medium to form an image on the recording medium. The term "image formation" includes aspects of providing not only meaningful images, such as characters and figures, but also meaningless images, such as patterns, to a recording medium. Further, the tem' "image formation" includes not only two-dimensional image but includes three-dimensional image (solid image).

The liquid discharge head 5 is a functional component that discharges droplet from the nozzles 56. As an actuator of the liquid discharge head 5, other than a piezoelectric actuator, a thermal actuator using a thermoelectric conversion element can be used. The piezoelectric actuator deforms a vibration plate to change a volume of the individual chambers 55 so as to increase the pressure inside the individual chambers 55 to discharge droplet. The thermal actuator drives the thermoelectric conversion element to generate air bubble that increases the pressure inside the individual chambers 55 to discharge droplet.

Moreover, "recording medium" includes not only paper but also any materials onto which droplet can adhere, such as, an overhead projector (OHP) sheet, fabric, textile, leather, metal, glass, wood, ceramics, etc., and is used as a generic term for a recording medium, recording paper, a recording sheet, etc.

In the present disclosure, discharged liquid is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication. A liquid discharge device is an integrated unit including the liquid discharge head 5 and a functional part(s) or unit(s), and is an assembly of parts relating to liquid discharge. For example, the liquid discharge device includes at least one of the liquid discharge head 5, the carriage 4, the sub-tank 6, an ink supply device, and the maintenance device 20. The ink supply device includes the main tank mounting portion 10, the main tank 3, and the supply pump 8.

In the above-described embodiments of the present disclosure, the liquid discharge apparatus includes a liquid discharge device that drives the liquid discharge head 5 to discharge liquid. The liquid discharge apparatus may be, for example, an apparatus capable of discharging liquid onto a material, to which liquid can adhere, or an apparatus to discharge liquid toward gas or into another liquid. The liquid discharge apparatus includes a three-dimensional fabricating apparatus, a liquid coating apparatus, and a toner manufacturing apparatus, etc.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a liquid discharge head having nozzles formed therein, to discharge liquid from the nozzles; and a cap to contact with or separate from the liquid discharge head to maintain the liquid discharge head, wherein the liquid discharge head includes:

a common chamber connected to the nozzles;

a liquid supply port provided at one end of the liquid discharge head in a longitudinal direction of the liquid discharge head to supply liquid to one end of the common chamber; and a liquid discharge port provided at another end of the liquid discharge head in the longitudinal direction of the liquid discharge head to discharge liquid, which flows through the common chamber and is not discharged from the nozzles, from another end of the common chamber, wherein the cap includes:

a drainage supply port to be connected with the liquid discharge port of the liquid discharge head with a connection path; and a drainage discharge port to be connected with a suction pump to discharge liquid inside the cap.

2. The liquid discharge apparatus according to claim 1, wherein the liquid discharge head further comprises:

a plurality of individual chambers connected to the nozzles; and a plurality of actuators provided at the plurality of individual chambers to generate pressure inside the plurality of individual chambers, wherein the common chamber is connected to the plurality of individual chambers.

3. The liquid discharge apparatus according to claim 1, wherein the connection path between the drainage supply port of the cap and the liquid discharge port of the liquid discharge head are detachably connected.

4. The liquid discharge apparatus according to claim 3, wherein the connection path includes couplings to detachably connect the drainage supply port of the cap and the liquid discharge port of the liquid discharge head.

5. A method for maintaining a liquid discharge apparatus including a liquid discharge head and a cap, the method comprising:

connecting the liquid discharge head and the cap with a connection path with the cap separated from a nozzle face of the liquid discharge head;

supplying cleaning liquid to the liquid discharge head connected to the cap with the connection path to supply the cleaning liquid to the cap through the liquid discharge head and the connection path;

discharging the cleaning liquid from the cap connected to the liquid discharge head with the connection path; and repeating the supplying and the discharging to replace liquid inside the liquid discharge head and the cap with the cleaning liquid.

6. The method according to claim 5, wherein the connecting is performed after moving the liquid discharge head to a position that minimizes a distance between the liquid discharge head and the cap.

7. The method according to claim 6, wherein the position is where the liquid discharge head is contactable against the cap.

* * * * *